US010425760B2

(12) United States Patent
Eronen et al.

(10) Patent No.: US 10,425,760 B2
(45) **Date of Patent: *Sep. 24, 2019**

(54) FITTING BACKGROUND AMBIANCE TO SOUND OBJECTS

(71) Applicant: Nokia Technologies Oy, Espoo (FI)

(72) Inventors: Antti Johannes Eronen, Tampere (FI); Jussi Artturi Leppanen, Tampere (FI); Arto Juhani Lehtiniemi, Lempäälä (FI)

(73) Assignee: Nokia Technologies Oy, Espoo (FI)

( * ) Notice: Subject to any disclaimer, the term of this patent is extended or adjusted under 35 U.S.C. 154(b) by 0 days.

This patent is subject to a terminal disclaimer.

(21) Appl. No.: 15/959,382

(22) Filed: Apr. 23, 2018

(65) Prior Publication Data

US 2018/0242096 A1 Aug. 23, 2018

Related U.S. Application Data

(63) Continuation of application No. 15/278,528, filed on Sep. 28, 2016, now Pat. No. 9,986,357.

(51) Int. Cl.
*H04S 7/00* (2006.01)
*H04R 5/027* (2006.01)

(52) U.S. Cl.
CPC ..... *H04S 7/301* (2013.01); *H04S 7/30* (2013.01); *H04S 7/307* (2013.01); *H04R 5/027* (2013.01);

(Continued)

(58) Field of Classification Search
CPC ..... H04S 7/301; H04S 7/307; H04S 2400/11; H04S 2400/15
See application file for complete search history.

(56) References Cited

U.S. PATENT DOCUMENTS 8,160,270 B2 4/2012 Oh et al.
9,319,821 B2 4/2016 Arrasvuori et al.
(Continued)

FOREIGN PATENT DOCUMENTS

EP 2786593 B1 4/2016

OTHER PUBLICATIONS

Haines, et al., Carnegie Mellon University, "Placement of Sound Sources in the Stereo Field Using Measured Room Impulse Responses", http://repository.cmu.edu/cgi/viewcontent.cgi?article=1478&context=compsci >, (10 pages).

*Primary Examiner* — Mark Fischer
(74) *Attorney, Agent, or Firm* — Harrington & Smith

(57) ABSTRACT

Embodiments of these teachings concern integrating a sound object such as an audio object recorded by, e.g., a lavalier microphone to a spatial audio signal. First the sound object is obtained and then a direction and an active duration of the sound object is determined. The spatial audio signal is compiled from audio signals of multiple microphones and could be pre-recorded and obtained after the fact. Then, using the determined direction, the sound object is integrated with the spatial audio signal over the active duration. If there are further moving sound sources to integrate the same procedure is followed for them all individually. One technique specifically shown herein to find the optimized direction and starting time is steered response power with phase transform weighting.

22 Claims, 4 Drawing Sheets

(52) U.S. Cl.
CPC ..... *H04S 2400/11* (2013.01); *H04S 2400/15* (2013.01)

(56) References Cited

U.S. PATENT DOCUMENTS

| | | | | |
|---|---|---|---|---|
| 9,986,357 | B2 * | 5/2018 | Eronen | H04S 7/307 |
| 2009/0264114 | A1 | 10/2009 | Virolainen | |
| 2013/0259243 | A1 | 3/2013 | Herre et al. | |
| 2013/0094672 | A1 | 4/2013 | Liang | |
| 2015/0055797 | A1 | 2/2015 | Nguyen et al. | |
| 2016/0125867 | A1 | 5/2016 | Jarvinen et al. | |
| 2016/0142851 | A1 | 5/2016 | Sun | |

* cited by examiner

FITTING BACKGROUND AMBIANCE TO SOUND OBJECTS

CROSS-REFERENCE TO RELATED APPLICATIONS

This application is a continuation of U.S. patent Ser. No. 15/278,528, by Antti Johannes Eronen et al., filed on Sep. 28, 2016, the disclosure of which is hereby incorporated by reference in its entirety.

TECHNOLOGICAL FIELD

The described invention relates to audio signal processing, and is more particularly directed towards the mixing of spatial audio signals such as background sounds with moving sound objects that represent a foreground sound from a source in motion. The background and foreground sounds may be recorded at different times and places.

BACKGROUND

Spatially mixing audio signals is known in the audio arts and it is further known to mix new background sounds to a foreground sound. There is a challenge when the new background sound is mixed with a foreground sound from a moving source. If not carefully done the new background sound can obscure portions of the foreground sound. The background sound is referred to as a spatial audio signal and the foreground sound is referred to as a sound object. The key is to mix the spatial audio signal to the sound object in such a manner that the listener of the mixed result can still perceive the audio object, can perceive it as moving, and the addition of the spatial audio signal enhances the overall audio experience. Simply mixing different audio objects on a new ambiance does not guarantee that the objects will be well audible throughout the entire recording at different spatial locations because some elements of the background ambiance may mask some of the objects.

It is known for a recording device to transmit or otherwise provide the orientation information for the spatial audio so that the receiving device could optimize sound reproduction by knowing such captured orientation information. But this can be improved upon and embodiments of these teachings provide a way to intelligently spatially mix sound objects to a new background ambiance by analyzing the background ambiance and automatically finding suitable spatiotemporal locations where to mix new sound objects.

SUMMARY

According to a first embodiment of these teachings is a method comprising: obtaining a sound object audio file; determining a direction and an active duration of the sound object audio file; obtaining a spatial audio signal compiled from audio signals of multiple microphones; and using the determined direction, integrating the sound object audio file with the spatial audio signal over the active duration.

According to a second embodiment of these teachings is an apparatus comprising at least one processor and at least one computer readable memory storing program code. In one example such an apparatus is audio mixing equipment. In this embodiment the at least one processor is configured with the at least one memory and program code to cause the apparatus to at least: obtain a sound object audio file; determine a direction and an active duration of the sound object audio file; obtain a spatial audio signal compiled from audio signals of multiple microphones; and using the determined direction, integrate the sound object audio file with the spatial audio signal over the active duration.

According to a third embodiment of these teachings is a non-transitory computer readable memory tangibly storing program code that when executed by at least one processor causes a host apparatus to at least: obtain a sound object audio file; determine a direction and an active duration of the sound object audio file; obtain a spatial audio signal compiled from audio signals of multiple microphones; and using the determined direction, integrate the sound object audio file with the spatial audio signal over the active duration.

In a more particular embodiment the determined direction is an optimized starting direction of the sound object audio file, and further there can be determined a starting time for the sound object audio file and the integrating comprises, beginning at the determined starting time, mixing the sound object audio file with the spatial audio signal.

In one non-limiting example below the sound object audio file is a first sound object audio file and determining the optimized starting direction of the first sound object audio file includes: a) for each of an initial starting direction $\varphi$ and at least one further starting direction $\varphi+1$ of the first sound object audio file, accumulating over the duration of the first sound object audio file at least one of the calculated SRP or an amount of other sound object audio files coinciding with the first sound object audio file; b) choosing a minimum spatial energy from the accumulating; and c) determining the optimized starting direction from the minimum spatial energy. As will be detailed below in one embodiment the SRP is calculated using phase transform PHAT weighting. More specifically for this example, each of the initial starting direction and the at least one other starting direction the SRP with PHAT weighting yields observed spatial energy $z_{no}$ as particularly detailed below at equation (1).

In another non-limiting embodiment, for each of the initial starting direction $\varphi$ and the at least one further starting direction $\varphi+1$ of the first sound object audio file, the accumulating is for a chosen first starting time and the accumulating is repeated for at least one further starting time. In this case there is also determined an optimized starting time for the first sound object audio file from the minimum spatial energy, and the first sound object audio file is mixed with the spatial audio signal so as to dispose a start of the first sound object audio file at the optimized starting time.

In certain of the described examples and use cases the spatial audio signal is captured at a microphone array of a first device and the first sound object audio file is captured at one or more microphones in motion such as a lavalier microphone(s), and these are captured at different times (e.g., non-simultaneous capture). These sound files may be obtained by the apparatus mentioned above through a variety of means such as via intermediate computer memories on which the different audio files are stored. The apparatus can then itself digitally store a result of the integrating, and/or audibly output a result of the integrating if the sound mixing apparatus also has loudspeakers or output jacks to such loudspeakers.

These and other embodiments are detailed more fully below.

DETAILED DESCRIPTION

Example embodiments of these teachings illustrate the inventors' techniques for automatically mixing of moving microphone audio sources to a spatial audio, with the aid of automatic microphone positioning techniques. The end result is to control the mixing of moving audio sources, also referred to herein as the audio files of sound objects, to a new background ambiance. Embodiments of these teachings provide a method for automatically finding suitable spatial positions in a background ambiance where to mix moving audio sources/sound object audio files.

Figure 1:
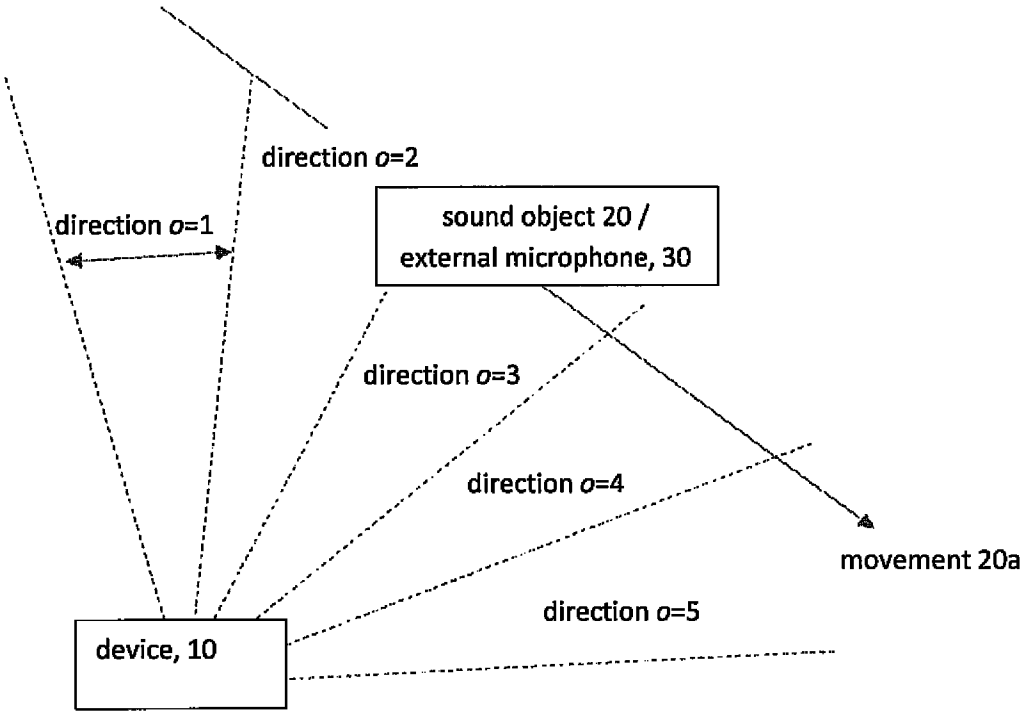
FIG. 1 is a conceptual view of an audio environment these teachings seek to re-create by intelligently adding a new background sound, captured by the device 10, to an audio object captured by the moving external microphone 20 even though these different audio signals may have been captured at different times and places.
Figure 2:
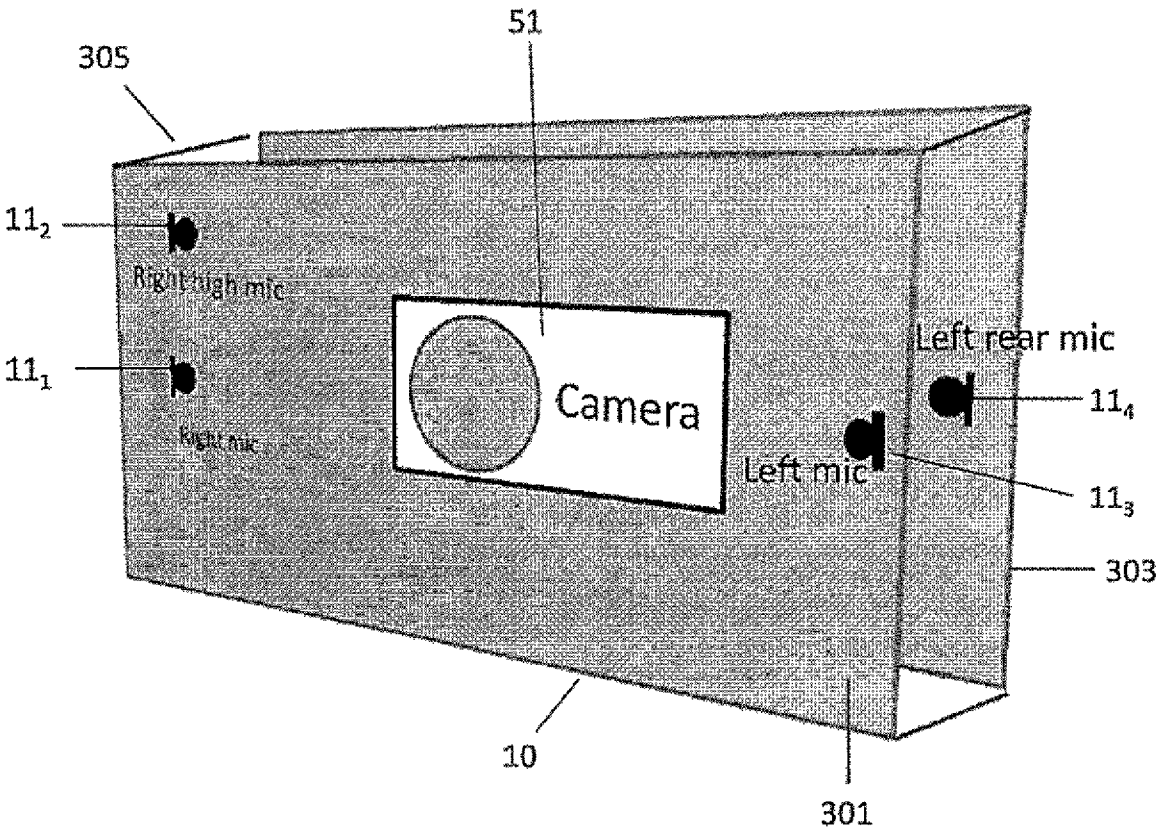
FIG. 2 is a perspective view of an example device having multiple microphones at different spatial locations, and illustrates a device for capturing a spatial audio signal.

FIG. 1 conceptualizes an audio environment that the mixing herein seeks to replicate, and FIG. 2 illustrates further detail of the device 10 shown at FIG. 1. At FIG. 1 there is an audio recording device 10 having two or more microphones in an array. A non-limiting example of such a device 10 can be professional motion picture camera equipment or even a smartphone defining a housing 305 and having a camera 51 and a microphone array comprising four microphones $\mathbf{11}_1$, $\mathbf{11}_2$, $\mathbf{11}_3$ and $\mathbf{11}_4$. In the mathematical description below these microphones are indexed by the integer m such that m=1, 2, 3, . . . , M where M is an integer greater than one representing the total number of microphones being considered. The microphones of the FIG. 2 device 10 capture the ambient sound.

The external microphone 30 of FIG. 1 captures a sound object and the end result of the mixing described herein is to replicate the audio environment shown at FIG. 1. In fact, for many deployments the audio signals captured by the device 10 versus the sound object audio file captured by the external microphone 30 are at different times and places. Mixing according to these teachings is to combine them in a way to mimic what FIG. 1 illustrates even though the background audio captured by the device 10 may not have ever been simultaneous with the sound object 20 captured by the external microphone 30. In the mixing that results, the moving audio source/sound object audio file 20 is combined so as to be perceived as moving 20*a* in the direction shown. To do so properly it is often necessary to find the correct starting position as well as the movement direction 20*a* to insert that moving audio source into the background audio/spatial audio signal. The spatial audio signal represents audio captured by multiple microphones such as those of FIG. 2.

It is simplest to understand the mixing described below if we assume the external microphone 30 is akin to a lavalier microphone worn as a pendant on a speaker's person; the array of microphones at the device 10 are recording some background sound that the audio engineer wishes to add as background to the moving audio source/sound object audio file 20 captured at the lavalier microphone 30. In this example the speaking or singing of the moving person may be considered to represent a moving audio source/sound object 20 as shown in FIG. 1. These teachings consider how to mix a spatial audio signal that is captured/recorded at the device 10 with audio signals of the sound object 20 that are captured/recorded at the external microphone 30. To keep the distinction among these different recordings clear, the spatial audio is referred to herein as a spatial audio signal while the moving audio source is referred to as a sound object or sound object audio file. Consider an example; a film-maker may use a lavalier microphone to capture sounds from a tiger in a zoo, and replace the background zoo sounds with those of an actual jungle. This new and desired background sound is the spatial audio signal captured by the device 10, and the film-maker seeks to mix that with the sound object audio file of the tiger so the movie-goer perceives the audio environment that FIG. 1 shows. The sound object audio file may be captured by one or multiple microphones. For the case in which the sound engineer seeks to mix multiple different sound object audio files such different recordings of the tiger and her cubs to the same jungle background spatial audio signal, these distinct sound object audio files can be added individually according to the teachings herein, or a global start time within the spatial audio signal may be used for some or all of these distinct sound object audio files.

In another use case, assume that during post processing of spatial audio content the sound engineer wishes to change the spatial audio to which the moving sources are mixed to. The engineer may recapture the spatial audio track, for example without the lavalier sources, and use that instead. There are valid reasons for a sound engineer to do this but doing so creates a different problem in that some elements of the background ambiance may end up masking some of the moving sources.

Traditionally a lavalier source was a microphone attached to a person (for example, as a necklace pendant) but with modern electronics and ubiquitous data collection a lavalier source as used herein includes any microphone that is moving while recording audio, regardless of whether its movements are associated with that of a person.

The solution for how to properly mix these recordings is described in detail below, but begins with finding two pieces of information:

a) an initial orientation for the moving audio source/sound object 20; and b) the temporal time instant when the mixing is started.

Now consider an example solution according to these teachings. The spatial audio (e.g., from the device 10 that is to be the background ambiance in the mixed end result) is divided into sectors as shown in FIG. 1; for this example assume each of these sectors defines a 20 degree resolution. More generally these sectors can be considered to be indexed by the integer o such that o=1, 2, 3, . . . O where O is an integer greater than one representing the total number of sectors being considered. In FIG. 1 there is only one moving audio source/sound object 20 but in various embodiments there may be more moving audio sources than only the single illustrated external sound object 20.

Starting from a first moving audio source/sound object 20, the system employing these teachings selects a first initial sector, and simulates the moving audio source/sound object 20 movement 20*a* in the spatial audio sectors across the duration of that sound object. The system accumulates a counter which indicates how many conflicting sounds happen to be in the sectors visited by the moving audio source/sound object 20 across its duration. Alternatively the system can use a Steered Response Power SRP method, for example implementing equation 1 below. Then the system changes the initial sector, and makes the same comparison again. At the end of this sub-process, all sectors have received a score of conflicting moving audio sources. Based on these scores, the system may select the optimal initial sector, which it sets as the initial sector for placing the moving audio source/sound object 20 (captured with the lavalier microphone 30) in the spatial audio.

This may be repeated for other lavalier sources. When there are multiple lavalier sources that the system considers one after the other, preferably the already inserted lavalier sources are used when counting the scores. In this manner the system helps avoid lavalier sources from colliding into the same sectors.

Another parameter available for the system is the timing when to start mixing a given moving audio source 30: the system can also divide the time into slots, for example 5 seconds, and start mixing the lavalier source 30 in different time slots. The above analysis may be repeated for the time slots, and the best time slot can then be selected.

Consider again the device 10 of FIG. 2 that has two or more microphones at locations shown in FIG. 2 and indexed as m=1, . . . , M in an array. The microphone array signals $\tilde{x}_m(t)$ are sampled at discrete time instances indexed by t. As shown at FIG. 1 there are one or more moving audio sources 20 around the device 10. The moving audio sources 20 may be captured by the microphone array on the device 10. Additionally, the moving audio sources may be captured by one or more external microphones 30.

The microphone signals are typically processed in frequency domain obtained by the short time Fourier transform (STFT). It is known that the STFT of a time domain signal may be calculated by dividing the microphone signal into small overlapping windows, applying the window function and taking the discrete Fourier transform (DFT) of it. The microphone signals in the time-frequency domain are then $x_{fn}=[x_{f,n,1}, \ldots, x_{f,n,M}]^T$, where time frames are n=1, . . . , N, frequency is f=1, . . . , F, and microphone index is 1, . . . , M.

FIG. 1 further showed the division of sectors around the device 10 where o=1 . . . O represents the set of directions around the device 10. The observed spatial energy $z_{n,o}$ over all directions o and around the microphone array is calculated using steered response power (SRP) with phase transform (PHAT) weighting, for example by an algorithm that implements equation 1 below. In other embodiments other methods may be used. In this case the observed spatial energy using SRP with PHAT weighting is:

$$z_{no} = \sum_{u=1}^{M} \sum_{m=u+1}^{M} \sum_{f=1}^{F} \left( \frac{x_{fnu} x_{fnv}^*}{|x_{fnu} x_{fnv}^*|} e^{j2\pi f(\tau(o,u)-\tau(o,m))} \right)^2 \quad (1)$$

where τ(o,m) is the time it takes sound to arrive from direction o to microphone m. To simplify the above mathematical exposition all sound sources are assumed to be at a fixed distance from the device center; 2 meters is a typical value for this assumption.

The analysis of the SRP-PRAT indicates how much spatial energy $z_{n,o}$ there is at each direction o around the device 10 at different times n. To fit the moving audio source/sound object(s) to the spatial audio the remaining problem is then to decide the starting direction o(s,1) for each external microphone source s=1, . . . , S, where S is the total number of external microphone captured sources. In FIG. 1 the sound captured by the external microphone 30 is such a moving audio source s. Each external microphone source 30 has a spatial position o(s,n) at each point in time.

In general, the starting direction φ is selected such that, when the moving audio source s is mixed starting from direction o(s,1)+φ, the amount of spatial energy in the background ambiance $z_{n,o}$ coinciding with the directions o(s,n)+φ of the moving audio source s is minimized. Formally, the goal is to minimize:

$$Z(s,\varphi)=\Sigma_{n=1}^{N} z_{n(o(s,n)+\varphi)} \quad (2)$$

With respect to the starting direction (also referred to as the offset) φ there are at least two options: a different starting offset can be searched for each lavalier source 30, or the best global offset can be searched, which minimizes the sum for all lavalier sources 30. The benefit of the former approach where the offset is selected for each lavalier source 30 individually is that the lavalier sources 30 may be best perceived since the system can locate spatial trajectories where the least amount of energy coincides with the particular moving audio source. However, the disadvantage is that the relative spatial positions of the lavalier sound sources 30 are not preserved. It is not universal which option is best and in a particular deployment of these teachings the user can choose which is most suitable for their intended purpose.

Figure 3:
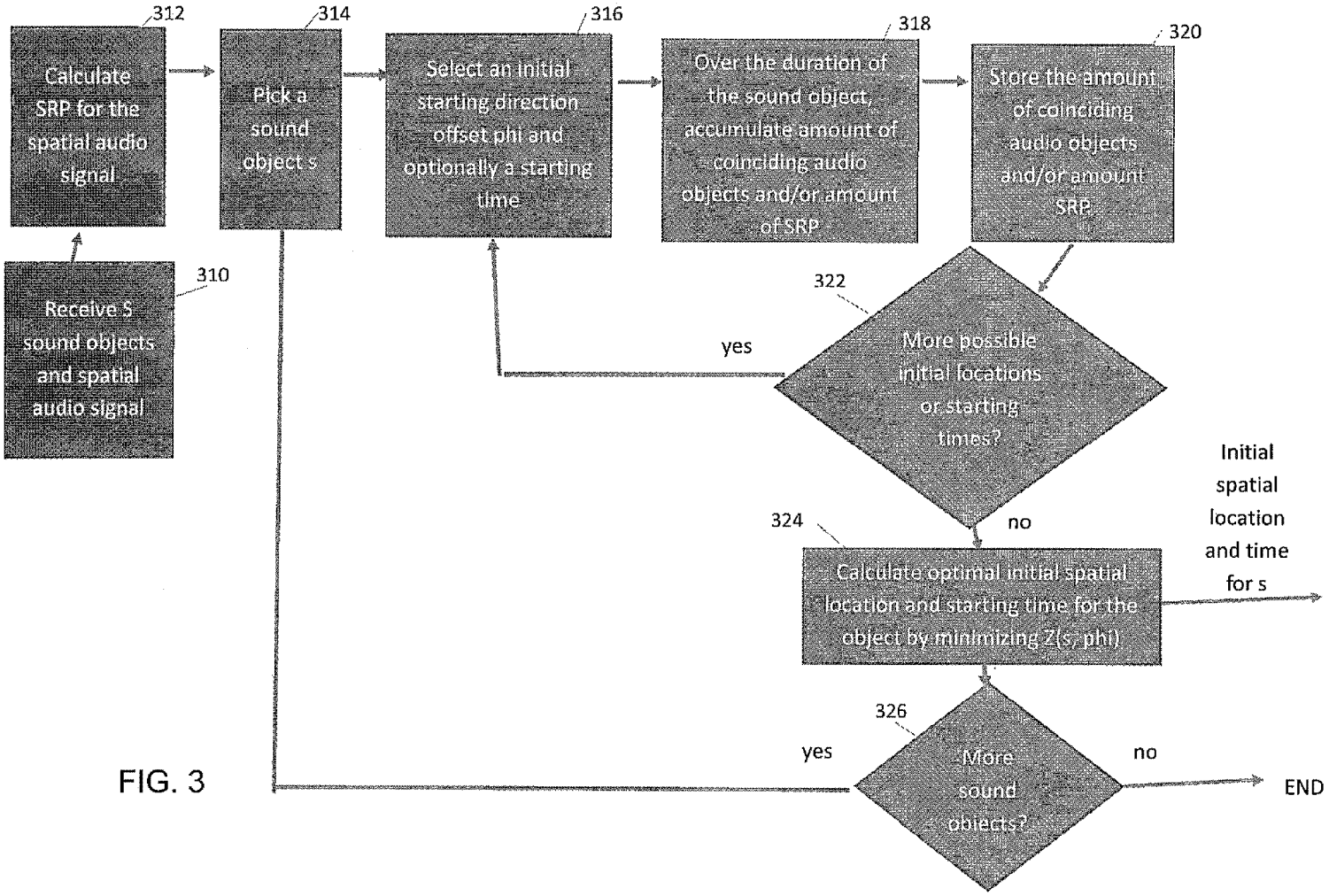
FIG. 3 is a process flow diagram summarizing certain aspects of the invention.

FIG. 3 is a process flow diagram that summarizes some of the above teachings. The process begins at block 310 where at least one moving audio source/sound object 20 is received at the audio mixing equipment that practices these teachings along with a spatial audio signal $x_{fn}$, representing a background ambiance to be mixed with that sound object. The steered response power SRP is calculated at block 312 and if there are multiple sound objects S>1 then one such object is chosen at block 314. An initial starting direction or offset φ is chosen at block 316 and above are described techniques to do so if there is more than one source: a different starting direction for each source or a best starting direction for all moving audio sources globally. If the starting time is to be calculated then also a starting time for the moving audio source is selected at block 316. For block 318, over the duration of the moving audio source/sound object the amount of other coinciding sound/audio objects and/or an amount of the SRP is calculated, as $z_{o,o}$ if the spatial energy is computed for different time windows. This value is stored at block 320 and the process of blocks 316, 318 and 320 are repeated for any remaining directions (and, times if starting time is also computed) per block 322. As shown in equation (1) above, then at block 324 the optimal initial spatial location (and optionally also the optimal initial starting time) is computed by finding the minimum for Z(s,φ). This minimum is the initial spatial location and starting time for the moving audio source/sound object chosen at block 314. If there are more moving audio sources/sound objects then block 326 has the process repeated from block 314 onward for those other sound objects; if not then the process is complete and the initial spatial location and starting time output from block 324 is used to determine exactly how to mix the sound object recorded by the lavalier microphone 30 to the spatial audio signal recorded by the device 10.

In addition to selecting the starting location, the system can also optimize with respect to the starting time n. In this case the above procedure is started at different starting locations within a range of allowed starting locations (for example, +/−5 seconds from a default starting location). The starting location and location offset minimizing the score may then be selected as the starting position of the moving audio source within the spatial audio signal. Again, the starting location optimization may be performed for each lavalier sound source 30 separately or for all lavalier sources 30 globally.

When the optimization is done for each lavalier source 30 separately, the system (audio mixing equipment) may also take into account external moving audio sources which are already at that spatial position at that time. In practice, this can be done by adding some amount (for example, 1) to the score being minimized if an external moving audio source is already at that position at that time.

The specific example detailed above utilizes the spatial resolution of the SRP-PHAT calculation. To speed up the search the system may use wider spatial sectors, for example 10 degree sectors. In this case the spatial energy can be summed across positions o belonging to the same sector, which decreases the amount of alternatives which need to be evaluated.

In some embodiments the system may automatically select the spatial resolution such as the width in degrees where to perform the fitting. For example, such sector width selection may be based on the number of sources, with more sources leading to narrower sectors. Alternatively, the sector width may be dynamically updated during the fitting process: if it seems that the system is not able to obtain low enough amounts of coinciding spatial energy for a given source s, it may perform the fitting again after narrowing the spatial sectors. This means that the system tries to increases its spatial resolution and this way find a suitable spatial trajectory for the source across the background ambiance.

Embodiments of these teachings can be used wherever spatial fitting of sound objects, which are recorded as audio files from moving microphones, need to be mixed to spatial audio recorded at a microphone array such as the example device 10. In general, the need for changing or capturing the background spatial audio separately arises from the need to control some desired aspects of the spatial audio that the sound engineer wishes to produce as his/her end product, such as amount and type of moving audio sources to be integrated. Often it is not feasible to capture the background spatial audio and the external microphone sources simultaneously.

One non-limiting example includes repositioning moving loudspeakers to a background spatial sound containing overlapping speakers. In another deployment it may be suitable to substitute some background speech babble with a new background that is captured for example from a more controlled audio environment such as a panel discussion. A further example includes repositioning a moving street musician or performer to a new background street ambiance that is captured and utilized for some desirable audio characteristics. A moving animal making sound can be mixed with a background jungle ambiance for a more authentic-to-nature overall audio experience.

Certain embodiments of these teachings provide the technical effect of spatially mixing sound sources (captured by the lavalier microphone 30) to a new background ambiance (e.g., captured by the device 10) such that the sources 20 go through regions with minimal energy. Another technical effect is that deployments of these teachings ensure an optimal spatial audio mix when mixing sound objects to a new ambiance. Such embodiments can also ensure that an audio object is audible throughout the end-result recording and not unnecessarily masked by portions of the background ambiance.

Further advantages is that continued use of certain of these teachings involves minimal user intervention and a high degree of automation in that it can quickly and automatically mix sound objects to different types of background ambiances.

These teachings can further be embodied as an apparatus, such as for example audio mixing equipment or ever components thereof that do the processing detailed above such as one or more processors executing computer program code stored on one or more computer readable memories. In such an embodiment the at least one processor is configured with the at least one memory and the computer program to cause the apparatus to perform the actions described above, for example at FIG. 3.

In this regard FIG. 3 can be considered as an algorithm, and more generally represents steps of a method, and/or certain code segments of software stored on a computer readable memory or memory device that embody the FIG. 3 algorithm for implementing these teachings. In this regard the invention may be embodied as a non-transitory program storage device readable by a machine such as for example the above one or more processors, where the storage device tangibly embodies a program of instructions executable by the machine for performing operations such as those shown at FIG. 3 and detailed above.

Figure 4:
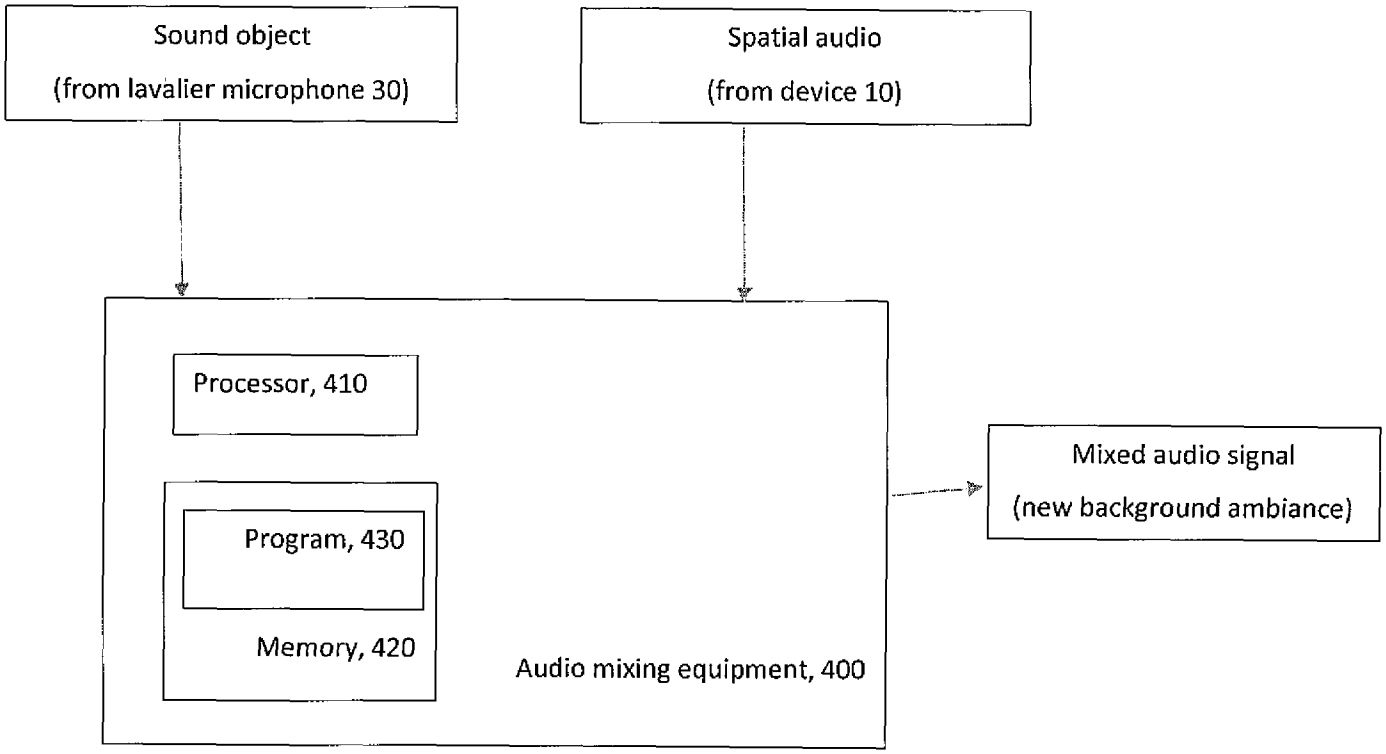
FIG. 4 is a diagram illustrating some components of audio mixing equipment that may be used for practicing various aspects of the invention.

FIG. 4 is a high level diagram illustrating some relevant components of such audio mixing equipment 400 that may implement various portions of these teachings. This audio mixing equipment takes as inputs the sound object which in the above non-limiting description is recorded at the lavalier microphone 30, and spatial audio that is recorded for example at microphone array of the device 10.

The audio mixing equipment 400 includes a controller, such as a computer or a data processor (DP) 410 (or multiple ones of them), a computer-readable memory medium embodied as a memory 420 (or more generally a non-transitory program storage device) that stores a program of computer readable instructions 430. The inputs and outputs assume interfaces, which may be implemented as ports for external drives, or for data cables, and the like. In general terms the audio mixing equipment 400 can be considered a machine that reads the MEM/non-transitory program storage device and that executes the computer program code or executable program of instructions stored thereon. While the audio mixing equipment 400 of FIG. 4 is shown as having one memory 420, in practice it may have multiple discrete memory devices and the relevant algorithm(s) and executable instructions/program code may be stored on one or across several such memories.

At least one of the computer readable programs 430 is assumed to include program instructions that, when executed by the associated one or more processors 410, enable the device 400 to operate in accordance with exemplary embodiments of this invention. That is, various exemplary embodiments of this invention may be implemented at least in part by computer software executable by the processor 410 of the audio mixing equipment 400; and/or by hardware, or by a combination of software and hardware (and firmware).

For the purposes of describing various exemplary embodiments in accordance with this invention the audio mixing equipment 400 may include dedicated processors.

The computer readable memory 420 may be of any memory device type suitable to the local technical environment and may be implemented using any suitable data storage technology, such as semiconductor based memory devices, flash memory, magnetic memory devices and systems, optical memory devices and systems, fixed memory and removable memory. The processor 410 may be of any type suitable to the local technical environment, and may include one or more of general purpose computers, special purpose computers, microprocessors, digital signal processors (DSPs) and processors based on a multicore processor architecture, as non-limiting examples. The data interfaces for the illustrated inputs and outputs may be of any type suitable to the local technical environment and may be implemented using any suitable communication technology such as radio transmitters and receivers, external memory device ports, wireline data ports, optical transceivers, or a combination of such components.

A computer readable medium may be a computer readable signal medium or a non-transitory computer readable storage medium/memory. A non-transitory computer readable storage medium/memory does not include propagating signals and may be, for example, but not limited to, an electronic, magnetic, optical, electromagnetic, infrared, or semiconductor system, apparatus, or device, or any suitable combination of the foregoing. Computer readable memory is non-transitory because propagating mediums such as carrier waves are memoryless. More specific examples (a non-exhaustive list) of the computer readable storage medium/memory would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing.

It should be understood that the foregoing description is only illustrative. Various alternatives and modifications can be devised by those skilled in the art. For example, features recited in the various dependent claims could be combined with each other in any suitable combination(s). In addition, features from different embodiments described above could be selectively combined into a new embodiment. Accordingly, the description is intended to embrace all such alternatives, modifications and variances which fall within the scope of the appended claims.

What is claimed is:

1. A method comprising:

obtaining a sound object;

determining a direction and an active duration of the sound object;

obtaining a spatial audio signal compiled from audio signals of multiple microphones; and using the determined direction, integrating the sound object with the spatial audio signal over the active duration.

2. The method according to claim 1, wherein the determined direction is a starting direction of the sound object.

3. The method according to claim 2, further comprising determining a starting time for the sound object; and the integrating comprises, beginning at the determined starting time, mixing the sound object with the spatial audio signal.

4. The method according to claim 2, wherein the sound object is a first sound object and determining the starting direction of the first sound object comprises:

for each of an initial starting direction and at least one further starting direction of the first sound object, accumulating over the active duration of the first sound object at least one of a calculated steered response power or an amount of other sound objects coinciding with the first sound object;

choosing a minimum spatial energy from the accumulating; and determining the optimized starting direction from the minimum spatial energy.

5. The method according to claim 4, wherein the steered response power is calculated using phase transform weighting.

6. The method according to claim 5, wherein for each of the initial starting direction and the at least one other starting direction the steered response power with phase transform weighting yields observed spatial energy over a time for the first sound object to arrive from a given direction to each of the multiple microphones.

7. The method according to claim 4, wherein for each of the initial starting direction and the at least one further starting direction of the first sound object, the accumulating is for a chosen first starting time and the accumulating is repeated for at least one further starting time;

wherein:

the determining further comprises determining a starting time for the first sound object from the minimum spatial energy, and integrating the first sound object with the spatial audio signal over the active duration further comprises arranging a start of the first sound object to the determined starting time.

8. The method according to claim 1, further comprising at least one of digitally storing a result of the integrating or audibly outputting a result of the integrating.

9. The method according to claim 1, wherein the method is repeated for each of multiple sound objects such that each respective sound object is integrated with the spatial audio signal over the respective active duration using the respective determined direction.

10. The method according to claim 1, wherein:

a microphone array, being part of a device, captured the spatial audio signal non-simultaneously with capture of the sound object using at least one microphone external to the device, and the at least one microphone captured the sound object while in motion.

11. An apparatus comprising:

at least one processor; and at least one computer readable memory storing program code;

wherein the at least one processor is configured with the at least one memory and program code to cause the apparatus to at least:

obtain a sound object;

determine a direction and an active duration of the sound object;

obtain a spatial audio signal compiled from audio signals of multiple microphones; and using the determined direction, integrate the sound object with the spatial audio signal over the active duration.

12. The apparatus according to claim 11, wherein the determined direction is a starting direction of the sound object.

13. The apparatus according to claim 12, wherein the at least one processor is configured with the at least one memory and program code to cause the apparatus to:

determine a starting time for the sound object; and integrate through, beginning at the determined starting time, mixing the sound object with the spatial audio signal.

14. The apparatus according to claim 12, wherein the sound object is a first sound object and the at least one processor is configured with the at least one memory and program code to cause the apparatus to determine the optimized starting direction of the first sound object through performing at least the following:

for each of an initial starting direction and at least one further starting direction of the first sound object, accumulate over the active duration of the first sound object at least one of a calculated steered response power or an amount of other sound objects coinciding with the first sound object;

choose a minimum spatial energy from the accumulating; and determine the starting direction from the minimum spatial energy.

15. The apparatus according to claim 14, wherein the steered response power is calculated using phase transform weighting.

16. The apparatus according to claim 15, wherein for each of the initial starting direction and the at least one other starting direction the steered response power with phase transform weighting yields observed spatial energy over a time for the first sound object to arrive from a given direction to each of the multiple microphones.

17. The apparatus according to claim 14, wherein for each of the initial starting direction and the at least one further starting direction of the first sound object, the accumulating is for a chosen first starting time and the accumulating is repeated for at least one further starting time;

wherein:

the determining further comprises determining a starting time for the first sound object from the minimum spatial energy, and integrating the first sound object with the spatial audio signal over the active duration further comprises arranging a start of the first sound object to the determined starting time.

18. The apparatus according to claim 11, wherein the at least one processor is configured with the at least one memory and program code to cause the apparatus to at least one of digitally store a result of the integrating or audibly output a result of the integrating.

19. The apparatus according to claim 11, wherein the at least one processor is configured with the at least one memory and program code to cause the apparatus to determine, obtain and integrate as said for each of multiple sound objects such that each respective sound object is integrated with the spatial audio signal over the respective active duration using the respective determined direction.

20. The apparatus according to claim 11, wherein:

a microphone array, being part of a device, captured the spatial audio signal non-simultaneously with capture of the sound object using at least one microphone external to the device, and the at least one microphone captured the sound object while in motion.

21. The apparatus of claim 20, wherein the microphone array comprises the multiple microphones.

22. A non-transitory computer readable memory tangibly storing program code that when executed using at least one processor causes a host apparatus to at least:

obtain a sound object;

determine a direction and an active duration of the sound object;

obtain a spatial audio signal compiled from audio signals of multiple microphones; and using the determined direction, integrate the sound object with the spatial audio signal over the active duration.

* * * * *